United States Patent [19]

Kessler

[11] Patent Number: 4,475,486

[45] Date of Patent: Oct. 9, 1984

[54] ENGINE INDUCTION SYSTEM

[75] Inventor: David R. Kessler, Churchville, N.Y.

[73] Assignee: General Motors Corporation, Detroit, Mich.

[21] Appl. No.: 350,049

[22] Filed: Feb. 18, 1982

[51] Int. Cl.[3] ..... F02M 35/10

[52] U.S. Cl. ..... 123/52 M; 123/442; 123/445

[58] Field of Search ..... 123/308, 432, 442, 52 M, 123/52 MV, 445, 472

[56] References Cited

U.S. PATENT DOCUMENTS

| | | | |
|---|---|---|---|
| 2,833,260 | 5/1958 | Dolza et al. . | |
| 2,860,616 | 11/1958 | Dermond . | |
| 2,862,489 | 12/1958 | Pringham . | |
| 2,911,203 | 11/1959 | Kolbe . | |
| 2,914,051 | 11/1959 | Dolza et al. . | |
| 3,678,905 | 7/1972 | Diehl | 123/432 X |
| 3,783,844 | 1/1974 | Gural | 123/52 MV |
| 3,785,354 | 1/1974 | Moulds | 123/52 MV X |
| 3,788,287 | 1/1974 | Falen et al. | 123/52 MV |
| 3,789,819 | 2/1974 | Moulds | 123/461 |
| 4,303,046 | 12/1981 | Nakanishi et al. | 123/308 |
| 4,378,761 | 4/1983 | Kawamura | 123/52 M |

FOREIGN PATENT DOCUMENTS

| | | | |
|---|---|---|---|
| 150516 | 11/1979 | Japan | 123/308 |

*Primary Examiner*—Parshotam S. Lall
*Assistant Examiner*—W. R. Wolfe
*Attorney, Agent, or Firm*—C. K. Veenstra

[57] ABSTRACT

A port fuel injection system for an automotive engine has injectors delivering fuel across an air gallery and through subsonic nozzles into the engine inlet manifold to provide enhanced mixing of air and fuel for combustion in the engine. A staged throttle mechanism operates a primary throttle controlling air flow through the air gallery and a secondary throttle controlling air flow directly into the manifold so that the air gallery provides substantially the entire air flow required for low speed light load engine operation.

2 Claims, 8 Drawing Figures

ENGINE INDUCTION SYSTEM

TECHNICAL FIELD

This invention relates to an air and fuel induction system adapted to enhance mixing of air and fuel for combustion in an engine.

BACKGROUND

Port fuel injection is a popular approach to preparation of an air-fuel mixture for combustion in an automotive engine. A port fuel injection system commonly has a central air inlet, from which air is distributed through an inlet manifold to the intake ports of the engine combustion chambers, and fuel injectors which deliver fuel into the inlet manifold adjacent each intake port. A throttle in the central air inlet controls the air flow to the engine, and the amount of fuel delivered by the injectors is proportioned to the air flow.

In such a system, the pressure in the inlet manifold varies as the operator moves the throttle in response to changing requirements for engine speed and load. If the fuel injectors deliver fuel directly into the inlet manifold, variations in the inlet manifold pressure will affect fuel delivery, and the system must have provision to compensate for manifold pressure variations. For example, in one port fuel injection system having electromagnetically operated fuel injectors, the injectors deliver fuel according to a predetermined duty cycle, and it is desired that the amount of fuel delivered by the injectors respond only to variations in the duty cycle. To avoid having variations in the inlet manifold pressure affect fuel delivery, the pressure of the fuel supplied to the injectors may be controlled so that the difference between the fuel supply pressure and the inlet manifold pressure is constant. However, to allow the fuel supply pressure to follow the wide variations in inlet manifold pressure, the fuel supply pump must be capable of supplying fuel over the corresponding range of fuel supply pressures.

In another port fuel injection system, the effect of inlet manifold pressure on injector fuel delivery is avoided by providing the injectors with an atmospheric vent. In such an arrangement, mixture nozzles open into the inlet manifold from a region of atmospheric pressure, and each injector delivers fuel across the atmospheric pressure region and through a mixture nozzle into the inlet manifold. The injectors thus discharge into a region of substantially constant atmospheric pressure, and the fuel supply system may be adapted to supply fuel at a substantially constant pressure.

However, to control air flow in such a system, air flow through the mixture nozzles is limited by a sonic flow restriction in each nozzle; air flow through the nozzles is thus restricted at the low manifold pressures which occur during low air flow conditions. As a result, when the manifold pressure increases in response to an increase in air flow to the engine, air flow through the mixture nozzles decreases; thus the increased fuel flow required by the increased air flow to the engine is accompanied by a decrease in air flow through the mixture nozzles, inhibiting the air-fuel mixing process.

SUMMARY OF THE INVENTION

This invention provides an air and fuel induction system which will enhance air-fuel mixing without requiring a fuel supply system responsive to the wide variations in inlet manifold pressure.

In an induction system according to this invention, fuel injectors discharge across an air gallery connected by subsonic nozzles to the inlet manifold; the air gallery provides substantially the entire air flow required for low speed light load engine operation, while the air flow required for high speed heavy load engine operation is provided both by the air gallery and directly by the inlet manifold. Thus throughout the range of engine operation, the fuel delivered by the injectors is initially mixed with a substantial air flow as it passes through the mixture nozzles into the inlet manifold, and then is further mixed with the air in the inlet manifold. This invention thereby enhances mixing of the air and fuel delivered to the engine combustion chambers.

A staged throttle mechanism is provided to control air flow to the engine, with a primary throttle controlling air flow through the air gallery and a secondary throttle controlling the remainder of the air flow directly into the inlet manifold.

Of course, with this invention the pressure in the air gallery varies as the operator moves the primary throttle in response to changing requirements for engine speed and load. It is contemplated, therefore, that the pressure of the fuel supplied to the injectors will be controlled so that the difference between the fuel supply pressure and the air gallery pressure will remain constant. With this invention, however, the air gallery pressure varies over a narrower range than the inlet manifold pressure, and the fuel supply pump need be capable of supplying fuel over a correspondingly narrower range of fuel supply pressures.

The details as well as other features and advantages of this invention are set forth in the remainder of the specification and are shown in the accompanying drawings.

BEST MODE FOR CARRYING OUT THE INVENTION

Figure 3:
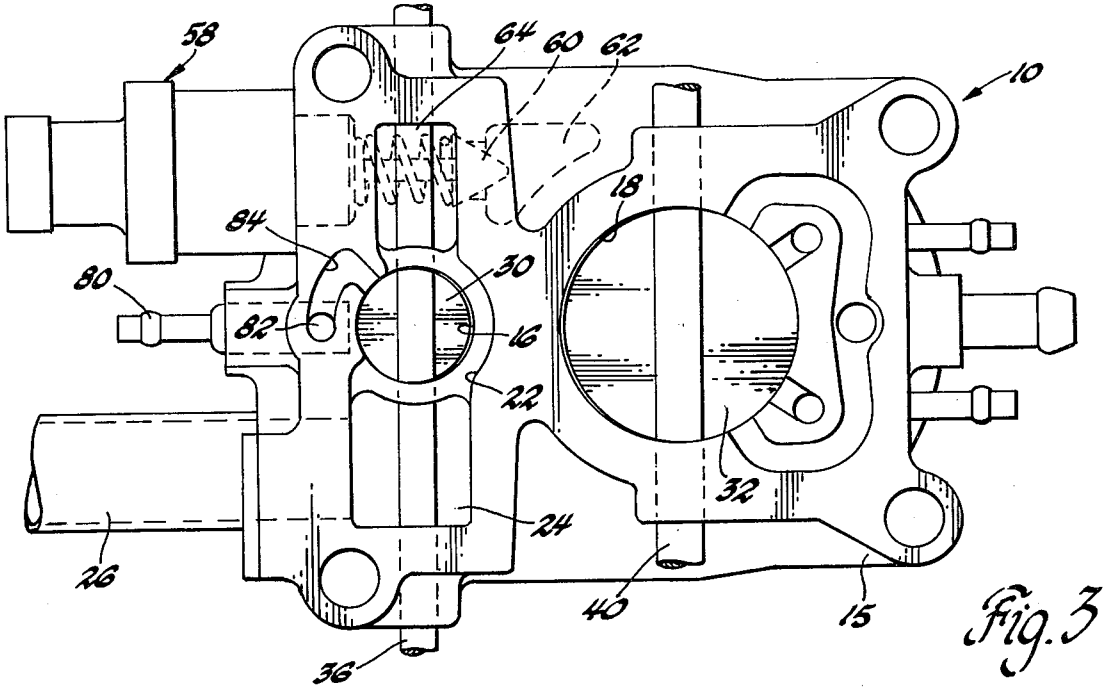
FIG. 3 is a bottom view of the air meter assembly, showing the air flow path from the primary throttle to the air gallery.

Referring to the drawings, an air meter assembly 10 and a distribution rail assembly 12 are mounted on the inlet manifold 14 of an automotive spark ignition internal combustion engine. Air meter assembly 10 comprises a throttle body 15 having a primary air inlet 16 and a secondary air inlet 18, with the primary air inlet 16 having a diameter about half the diameter of the secondary air inlet 18. Secondary air inlet 18 opens directly into the internal volume 20 of inlet manifold 14. However, as may be seen best in FIG. 3, primary air inlet 16 discharges through a recess 22 formed in the base of throttle body 15 to a cavity 24 extending upwardly from the base of throttle body 15. A connecting pipe 26 extends from cavity 24 to an air gallery 28 formed in distribution rail assembly 12. A primary throttle 30 controls air flow through primary air inlet 16, and a secondary throttle 32 controls air flow through secondary air inlet 18.

Figure 1:
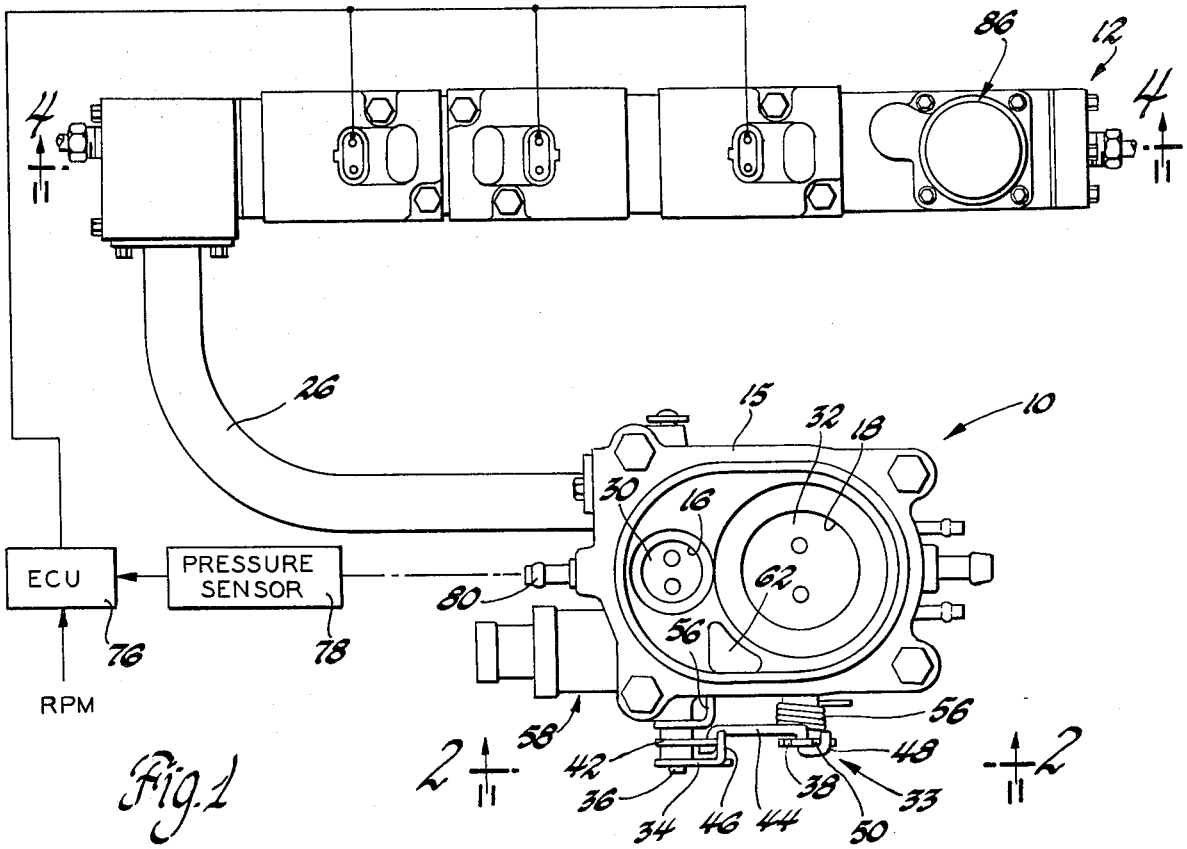
FIG. 1 is a plan view of a preferred embodiment of this induction system, showing an air meter assembly and a distribution rail assembly separated from an intake manifold.
Figure 2:
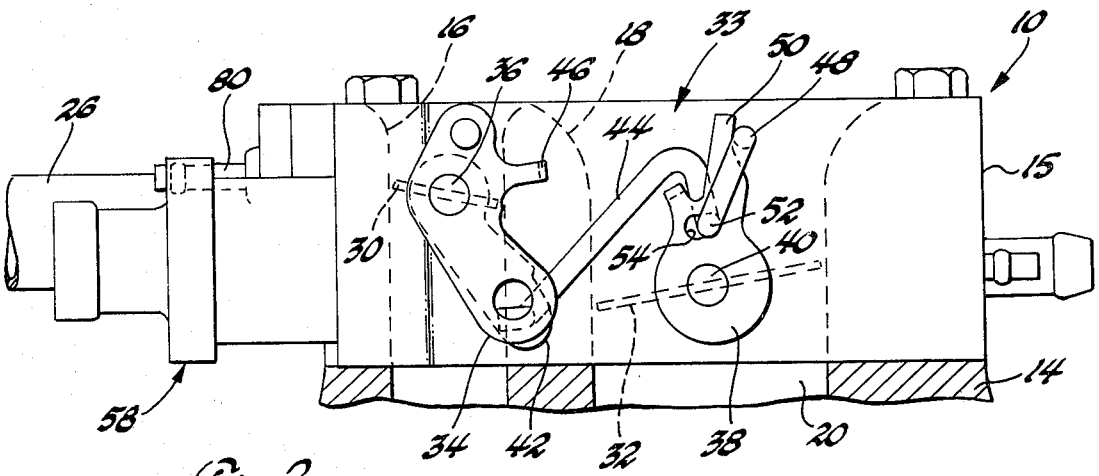
FIG. 2 is a side view of the air meter assembly, showing its relationship to an intake manifold and also showing the staged throttle mechanism.

Throttles 30 and 32 are linked by a staged throttle mechanism 33 as shown in FIGS. 1 and 2. Staged throttle mechanism 33 includes a primary throttle lever 34 secured on a shaft 36 carrying primary throttle 30 and a secondary throttle lever 38 secured on a shaft 40 carrying secondary throttle 32. A secondary drive lever 42 is journalled on primary throttle shaft 36 and is connected by a link 44 to secondary throttle lever 38. The structure and operation of staged throttle mechanism 33 are similar to that found in staged carburetors. Primary throttle lever 34 moves primary throttle 30 between closed and partially open positions while the remainder of staged throttle mechanism 33 remains stationary. When primary throttle lever 34 moves primary throttle 30 between partially open and wide open positions, a tang 46 on primary throttle lever 34 engages secondary drive lever 42 and causes secondary drive lever 42 to rotate with primary throttle lever 34; secondary drive lever 42 then operates link 44, which causes concomitant movement of secondary throttle lever 38 and secondary throttle 32 between closed and wide open positions. In the particular embodiment of the staged throttle mechanism shown here, the turned end 48 of link 44 engages arm 50 of secondary throttle lever 38 for initial opening movement of secondary throttle 32, and an intermediate portion 52 of link 44 engages the end of a slot 54 in secondary drive lever 38 for additional opening movement of secondary throttle 32. The staged throttle mechanism also includes conventional throttle return springs 56 not shown in detail here.

Air meter assembly 10 also includes an idle air control unit 58. Idle air control unit 58 has a valve 60 (FIG. 3) controlling air flow from an inlet 62 (FIGS. 1 and 3) at the top of throttle body 15 to a cavity 64 (FIG. 3) extending upwardly from the base of throttle body 15. Cavity 64 is connected through recess 22 with cavity 24 to supply additional air through connecting pipe 26 to air gallery 28. Idle air control unit 58 may be operated to provide the additional air flow required when idling at low engine temperature; it also may be operated to control air flow to maintain a desired idle speed.

Figure 5:
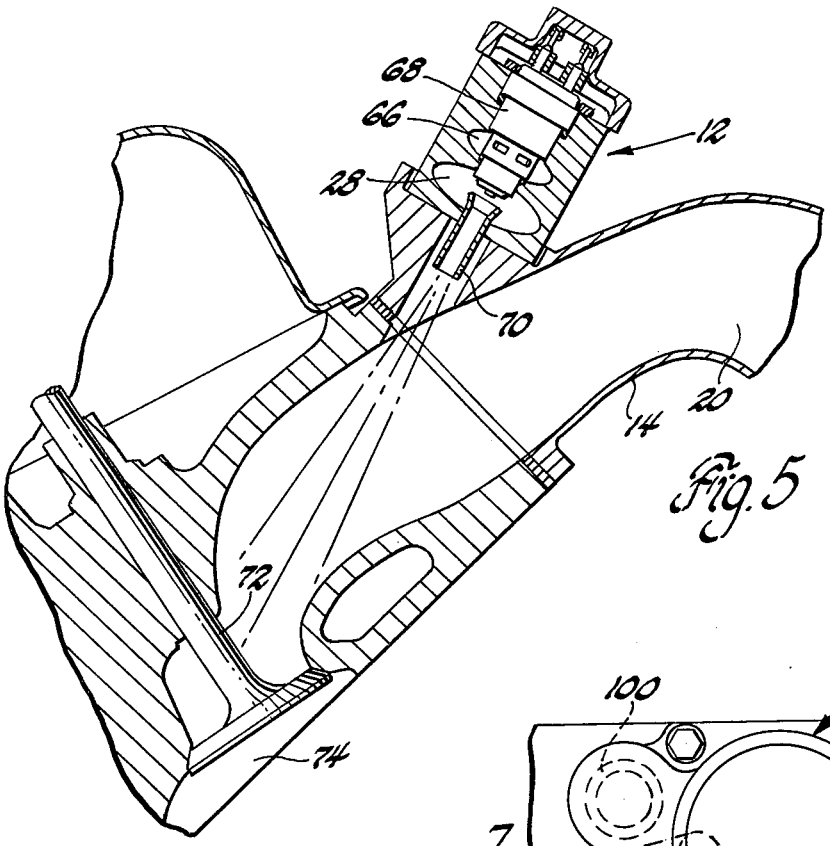
FIG. 5 is a sectional view of the distribution rail assembly, taken along line 5—5 of FIG. 4, further showing the relationship of the distribution rail assembly to an intake manifold and a combustion chamber intake valve.

Distribution rail assembly 12 has a fuel supply passage 66 which receives fuel from a fuel pump (not shown). A plurality of injectors 68 receive fuel from fuel passage 66 and deliver fuel across air gallery 28 into a plurality of subsonic mixture nozzles 70. As shown in FIG. 5, each mixture nozzle 70 opens from air gallery 28 into inlet manifold 14 adjacent the intake valve 72 of the associated engine combustion chamber 74. The total flow area provided by mixture nozzles 70 may be about one-half the air flow area provided by primary air inlet 16, and injectors 68 are spaced from mixture nozzles 70 such that the flow area therebetween is about one and one-half times the flow area of mixture nozzles 70.

Fuel injectors 68 are electromagnetic injectors of conventional construction operated according to a duty cycle established by an electronic control unit (ECU) 76 (FIG. 1). ECU 76 receives a signal from a pressure sensor 78 which is connected to primary air inlet 16 through a tube 80, internal passages 82 in throttle body 15, and a recess 84 on the base of throttle body 15. Pressure sensor 78 accordingly measures the pressure in primary air inlet 16 downstream of primary throttle 30 and thus measures the pressure in air gallery 28. ECU 76 also receives an RPM signal from an engine speed sensor, together with such other signals as may be appropriate so that injectors 68 may be energized to deliver fuel in proportion to air flow through air inlets 16 and 18.

Injectors 68 may be energized according to a variety of conventional schemes. For example, injectors 68 could be energized sequentially, each delivering fuel just before opening of the associated combustion chamber intake valve 72. Alternatively, injectors 68 could be energized simultaneously, all delivering fuel just before opening of each intake valve 72. In those arrangements, the frequency of injector operation would vary with engine speed, and at each event the injectors would be energized for the time required to deliver the desired amount of fuel. With the illustrated embodiment of this invention, however, it is contemplated that injectors 68 will be energized simultaneously, that at each event the injectors will be energized for a fixed time, and that the frequency of injector operation will be varied so that the injectors deliver the required amount of fuel.

Figure 4:
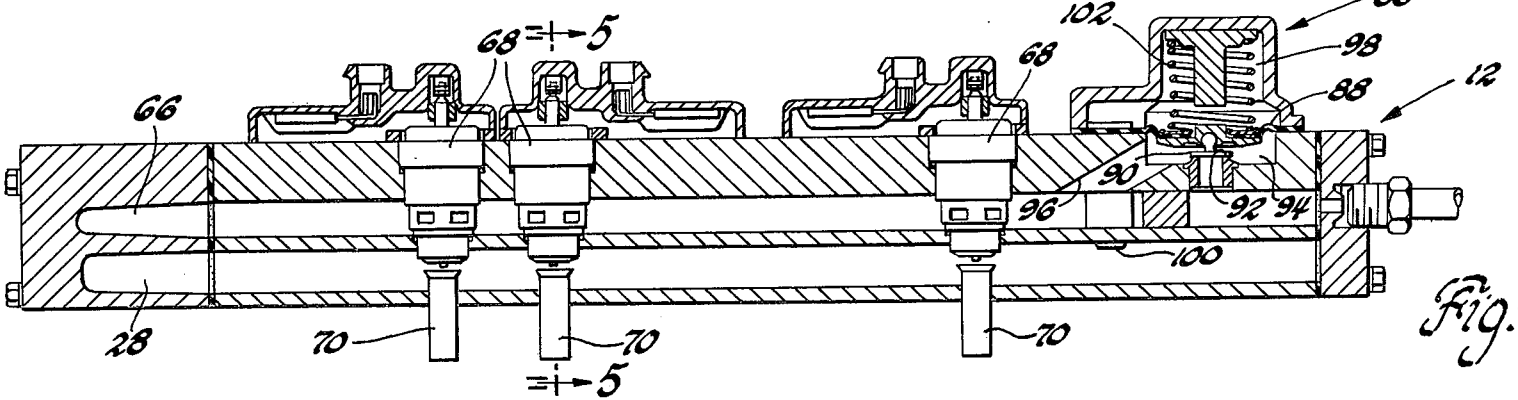
FIG. 4 is a sectional view of the distribution rail assembly, taken along line 4—4 of FIG. 1, showing the fuel supply passage, the fuel injectors, the air gallery, and the mixture nozzles.
Figure 6:
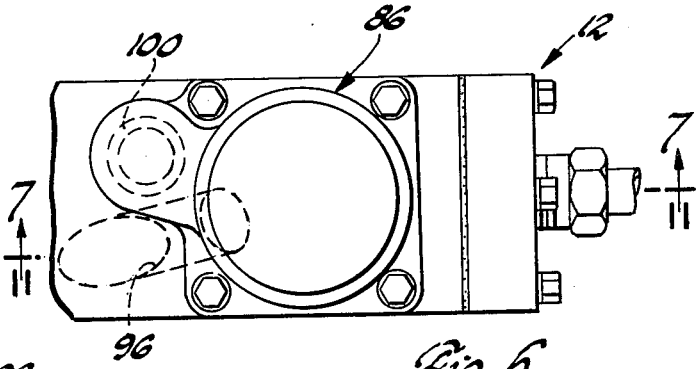
FIG. 6 is an enlarged plan view of a portion of the distribution rail assembly, showing connections of the pressure regulator to the fuel supply passage and the air gallery.
Figure 7:
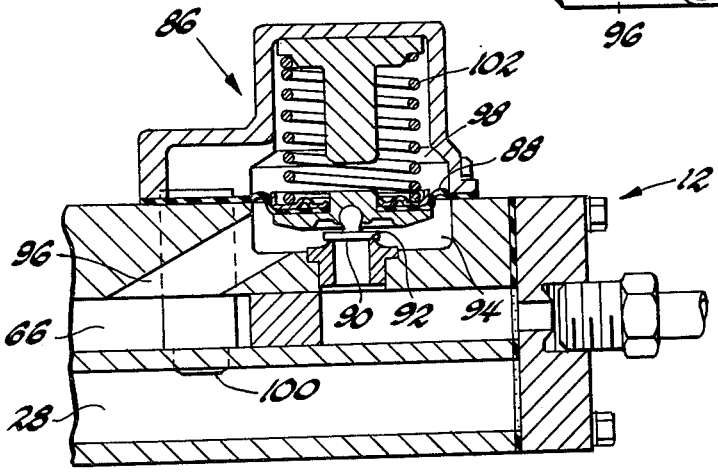
FIG. 7 is a sectional view of the distribution rail assembly, taken along line 7—7 of FIG. 6, further showing the connections of the pressure regulator to the fuel supply passage and the air gallery.

In this embodiment of the invention, it also is contemplated that fuel delivery will be controlled entirely by the duty cycle established by ECU 76. Accordingly, as shown in FIGS. 4 and 6–7, a pressure regulator 86 is employed to maintain the desired pressure in fuel supply passage 66. Pressure regulator 86 has a diaphragm 88 which positions a pressure regulator valve 90 to discharge excess fuel through a valve seat 92. The chamber 94 below diaphragm 88 is connected through a passage 96 with fuel supply passage 66, and the chamber 98 above diaphragm 88 is connected through a tube 100 with air gallery 28. The pressure in chamber 94 below diaphragm 88 is accordingly the same as the pressure of the fuel supplied to injectors 68 in passage 66, and the pressure in chamber 98 above diaphragm 88 is the same as the pressure in air gallery 28 on the delivery side of injectors 68. As primary throttle 30 is opened and the pressure in air gallery 28 increases, the pressure in chamber 98 above diaphragm 88 increases to cause diaphragm 88 to move valve 90 toward valve seat 92, and the pressure in supply passage 66 increases a corresponding amount. As primary throttle 30 is closed and the pressure in air gallery 28 decreases, the pressure in chamber 98 above diaphragm 88 decreases, and diaphragm 88 is raised against the bias of a spring 102; valve 90 is thereby displaced from valve seat 92 to discharge additional fuel from supply passage 66, and the pressure in supply passage 66 decreases a corresponding amount. Pressure regulator 86 is thus effective to maintain the difference between the fuel supply pressure and the air gallery pressure at a substantially constant amount.

Nozzles 70 isolate air gallery 28 from the full range of variations in pressure in inlet manifold 14. Accordingly, the full range of inlet manifold pressure does not act on the fuel injectors 68, and the fuel pump need supply fuel only at pressures necessary to follow the variations in pressure in air gallery 28. At the same time, air flow through nozzles 70 increases as throttles 30 and 32 are opened to increase engine air flow, and the required increase in fuel delivery by injectors 68 is accompanied by an increase in air flow through nozzles 70 to enhance air-fuel mixing. The resulting air-fuel mixture is further mixed with air in inlet manifold 14 and prepared for introduction through intake valve 72 to the combustion chamber 74.

Figure 8:
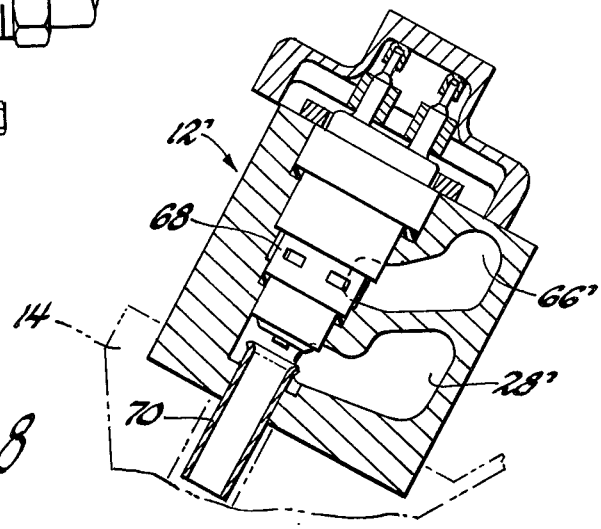
FIG. 8 is a sectional view, similar to that of FIG. 5, showing an alternate embodiment of the distribution rail assembly.

FIG. 8 shows a second embodiment 12' of a distribution rail assembly. Rail 12' is similar in most respects to rail 12 shown in FIGS. 1 and 4–7. However, instead of the oval air gallery 28 and the oval fuel supply passage 66 of extruded rail 12, extruded rail 12' has an air gallery 28' and a fuel supply passage 66' of irregular configuration. This is particularly advantageous because fuel injectors 68 receive fuel from the lowest portion of fuel supply passage 66', and considerable height is supplied in fuel supply passage 66' to allow separation of fuel vapor which may be entrained in the fuel delivered to fuel supply passage 66'.

The embodiments of the invention in which an exclusive property or privilege is claimed are defined as follows:

1. An air and fuel induction system for an engine having an inlet manifold adapted to supply an air-fuel mixture to a plurality of engine combustion chambers, said system comprising an air gallery having a plurality of mixture nozzles, each of said nozzles opening to said inlet manifold adjacent an associated engine combustion chamber, said nozzles being effective to maintain the pressure in said air gallery greater than the pressure in said inlet manifold during engine operation, said air gallery having a primary air inlet and said manifold having a secondary air inlet, said primary air inlet having a smaller flow area than said secondary air inlet, a plurality of fuel injectors, each of said injectors being associated with one of said nozzles and being adapted to deliver fuel across said air gallery into the associated nozzle for preliminary mixture with air flowing through the nozzle from said gallery to said manifold and for further mixture with air in said manifold, and means controlling said injectors to provide fuel delivery which varies with air flow through said air inlets, and wherein said system further comprises a primary throttle in said primary air inlet and a secondary throttle in said secondary air inlet, and staged throttle mechanism linking said throttles for moving said primary throttle between closed and partially open positions without moving said secondary throttle and for moving said primary throttle between partially open and wide open positions while concomitantly moving said secondary throttle between closed and wide open positions, said system being effective to increase air flow through said nozzles upon an increase in air flow through said air inlets whereby an increase in fuel delivery by said injectors in response to an increase in air flow through said air inlets is accompanied by an increase in air flow through said nozzles to enhance air-fuel mixing.

2. An air and fuel induction system for an engine having an inlet manifold adapted to supply an air-fuel mixture to a plurality of engine combustion chambers, said system comprising an air gallery having a plurality of mixture nozzles, each of said nozzles opening to said inlet manifold adjacent an associated engine combustion chamber, said nozzles being effective to maintain the pressure in said air gallery greater than the pressure in said inlet manifold during engine operation, said air gallery having a primary air inlet and said manifold having a secondary air inlet, said primary air inlet having a smaller flow area than said secondary air inlet, a plurality of fuel injectors, each of said injectors being associated with one of said nozzles and being adapted to deliver fuel across said air gallery into the associated nozzle for preliminary mixture with air flowing through the nozzle from said gallery to said manifold and for further mixture with air in said manifold, and means responsive to the pressure in said gallery for controlling said injectors to provide fuel delivery which varies with air flow through said air inlets, and wherein said system further comprises a primary throttle in said primary air inlet and a secondary throttle in said secondary air inlet, and staged throttle mechanism linking said throttles for moving said primary throttle between closed and partially open positions without moving said secondary throttle and for moving said primary throttle between partially open and wide open positions while concomitantly moving said secondary throttle between closed and wide open positions, said system being effective to increase air flow through said nozzles upon an increase in air flow through said air inlets whereby an increase in fuel delivery by said injectors in response to an increase in air flow through said air inlets is accompanied by an increase in air flow through said nozzles to enhance air-fuel mixing.

* * * * *